United States Patent [19]

Bezold

[11] Patent Number: 4,532,793

[45] Date of Patent: Aug. 6, 1985

[54] METHOD FOR DEEP-DRAWING SHEET METAL AND AN APPARATUS FOR CARRYING OUT THE METHOD

[75] Inventor: Helmut Bezold, Erlangen, Fed. Rep. of Germany

[73] Assignee: Kraftwerk Union Aktiengesellschaft, Mülheim an der Ruhr, Fed. Rep. of Germany

[21] Appl. No.: 534,549

[22] Filed: Sep. 22, 1983

[30] Foreign Application Priority Data

Sep. 27, 1982 [DE] Fed. Rep. of Germany ..... 3235716
Jul. 18, 1983 [DE] Fed. Rep. of Germany ..... 3325820

[51] Int. Cl.[3] ..... B21D 24/00
[52] U.S. Cl. ..... 72/342; 72/347; 72/350; 219/149
[58] Field of Search ..... 72/300, 301, 342, 350, 72/351, 364, 391, 354; 219/10.43, 10.57, 149

[56] References Cited

U.S. PATENT DOCUMENTS

| | | | |
|---|---|---|---|
| 438,409 | 10/1890 | Dewey | 219/149 |
| 1,530,000 | 3/1925 | Kauffman | 72/347 |
| 1,636,111 | 7/1927 | Rode | 72/351 |
| 2,460,519 | 2/1949 | Marchant | 219/149 |
| 3,051,830 | 8/1962 | Swain | 219/149 |
| 3,902,348 | 9/1975 | Hale | 72/342 |

FOREIGN PATENT DOCUMENTS

| | | | |
|---|---|---|---|
| 987343 | 8/1951 | France | 219/149 |

*Primary Examiner*—Lowell A. Larson
*Attorney, Agent, or Firm*—Herbert L. Lerner; Laurence A. Greenberg

[57] ABSTRACT

A method for deep-drawing sheet metal in a drawing apparatus having a drawing ring body, a pressure body, and a drawing plunger, which includes pushing a metal sheet having a deep-drawing region against the drawing ring body with the pressure body surrounding the deep-drawing region, pushing the drawing plunger against the deep drawing region, and heating the deep drawing region for deep-drawing, and an apparatus for carrying out the method.

2 Claims, 3 Drawing Figures

METHOD FOR DEEP-DRAWING SHEET METAL AND AN APPARATUS FOR CARRYING OUT THE METHOD

The invention relates to a method for deep-drawing sheet metal into a drawing ring by means of a drawing plunger, in which the sheet metal is pushed against the drawing ring by a pressure body surrounding a deep-drawing region, and an apparatus for carrying out the method.

Such a method is customary in the art. In the conventional method, the pressure body acts as means for holding down the sheet metal which is deep-drawn by the drawing plunger in a cold condition. The pressure which presses the hold-down means in the form of the pressure body against the drawing ring, can furthermore be chosen so high that the sheet metal is plasticized at the region of deep-drawing to improve its ability to be deep-drawn.

Even with this measure, it is not possible to perform deep-drawing free of cracks with this customary method, if the depth is to be relatively large.

It is accordingly an object of the invention to provide a method for deep-drawing sheet metal and an apparatus for carrying out the method, which overcomes the hereinafore-mentioned disadvantages of the heretofore-known devices of this general type, and with which even relatively large depths can be achieved without the formation of cracks in the sheet metal. With the foregoing and other objects in view there is provided, in accordance with the invention, a method for deep-drawing sheet metal in a drawing apparatus having a drawing ring body, a pressure body, and a drawing plunger, which comprises pushing a metal sheet having a deep-drawing region against the drawing ring body with the pressure body surrounding the deep-drawing region, pushing the drawing plunger against the deep-drawing region, and heating the deep-drawing region for deep-drawing. The sheet metal is therefore heated locally at the point of deep-drawing to a temperature at which it is readily deformable so that the development of cracks is impossible during the deep-drawing process, even in case of large depths. According to the method of the invention, deep-drawing is possible without cracks practically independently of the quality of the sheet metal to be worked. Since the sheet metal only requires heating locally and for a short time, flaking or scaling of the sheet metal in air and heating the deep-drawing tool, can be avoided.

In accordance with another mode of the invention, there is provided a method which includes a drawing apparatus having a counter plunger, which comprises clamping substantially the center of the deep-drawing region from opposite sides of the metal sheet between the drawing plunger and the counter plunger, and heating the deep-drawing region with an electric current flowing between at least one of the plungers and at least one of the bodies as well as through the deep-drawing region.

In accordance with a further mode of the invention, there is provided a method which includes a drawing apparatus having an induction coil, which comprises heating the deep-drawing region with a high-frequency electromagnetic field generated by the induction coil.

Further in accordance with the invention, there is provided an apparatus for deep-drawing sheet metal, comprising a drawing ring body, a pressure body for pushing a metal sheet with a deep-drawing region against the drawing ring body with the pressure body surrounding the deep-drawing region, a drawing plunger guidable through and insulated from the pressure body for clamping one side of the metal sheet substantially at the center of the deep-drawing region and for deforming the deep-drawing region, a counter plunger opposite the drawing plunger and guidable through and insulated from the drawing ring body for clamping a side of the metal sheet opposite the one side substantially at the center of the deep-drawing region, and an electric current source connected to at least one of the plungers and at least one of the bodies for heating the deep-drawing region for deep-drawing.

In accordance with another embodiment of the invention, there is provided an apparatus for deep-drawing sheet metal, comprising a drawing ring body, a pressure body for pushing a metal sheet with a deep-drawing region against the drawing ring body with the pressure body surrounding the deep-drawing region, a drawing plunger guidable through the pressure body for deforming the deep-drawing region, and an induction coil disposed in the drawing ring body for heating the deep-drawing region with a high-frequency electromagnetic field for deep-drawing. Other features which are considered as characteristic for the invention are set forth in the appended claims.

Although the invention is illustrated and described herein as embodied in a method for deep-drawing sheet metal and an apparatus for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
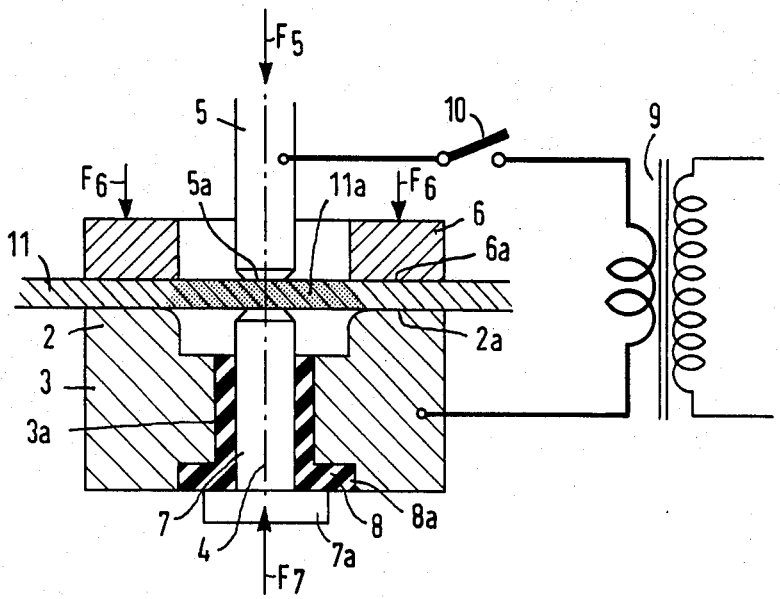
FIG. 1 is a fragmentary, schematic and diagrammatic longitudinal sectional view of an apparatus for carrying out the method according to the invention.

Referring now to the figures of the drawing in detail and first particularly to FIG. 1 thereof, there is seen a metallic drawing ring 2, which may be made of steel and which is formed on a metal socket 3, that may also be made of steel. The drawing ring 2 has a vertical ring axis 4. An elongated, cylindrical metal drawing plunger 5 which may also be made of steel, is associated with the drawing ring 2. The plunger 5 can be moved in the direction of the longitudinal axis thereof, coaxially with the drawing ring 2 and in the direction of the longitudinal axis thereof. The drawing plunger 5 is guided through an annular pressure body 6 formed of molybdenum, which is likewise disposed coaxially to the drawing ring 2 and opposite the drawing ring 2.

A counter plunger 7 extends through a bushing 3*a* coaxial to the drawing ring 2 in the metal socket 3 of the drawing ring 2. The counter plunger 7 is in the form of an elongated molybdenum cylinder. The longitudinal axis of the counter plunger 7 is coaxial to the drawing ring 2 and is likewise movable relative to the drawing plunger 5 in the direction of the longitudinal axis thereof. The counter plunger 7 is electrically insulated from the metal socket 3 by a sleeve 8 formed of insulating material, such as ceramic material, which is inserted into the bushing 3*a*. The drawing plunger 5 is similarly electrically insulated from the pressure body 6 and the metal socket 3 with the drawing ring 2. The movability of the counter plunger 7 toward the drawing plunger 5 is limited by a flange 7*a* which is disposed on the counter plunger 7 and which causes the counter plunger 7 to come to a stop outside the sleeve 8. The sleeve 8 is likewise secured against shifting toward the drawing plunger 5 by a flange 8*a* which is embedded in the metal socket 3.

The secondary winding of the transformer 9 is connected through a switch 10 to a connecting line connected to the drawing plunger 5 and through another connecting line to the metal socket 3 of the drawing ring 2.

The drawing plunger 5 and the counter plunger 7 associated therewith can be actuated along the direction of their longitudinal axes, such as by a non-illustrated pneumatic cylinder. Both pneumatic cylinders are rigidly fastened to the same non-illustrated support, which is also fastened to the metal socket 3. One pneumatic cylinder exerts a pressure $F_5$ on the drawing plunger 5 in the direction of the longitudinal axis of the drawing plunger 5, toward the counter plunger 7, and the other pneumatic cylinder exerts a counter pressure $F_7$ on the counter plunger 7 in the direction of the longitudinal axis of the counter plunger 7.

A metal sheet 11 formed of a zirconium-tin alloy (Zircaloy) which is 0.55 mm thick, is disposed between a flat contact surface 2*a* at one end of the drawing ring 2 and a similarly flat contact surface 6*a* at one end of the annular pressure body 6. The metal sheet 11 is pressed against the drawing ring 2 by means of a non-illustrated pressing device acting on the pressure body 6 with a pressure $F_6$ exerted perpendicular to the contact surface 2*a* and the contact surface 6*a*, forming an electric pressure contact between the contact surface 2*a* of the drawing ring 2 and the metal sheet 11. The drawing plunger 5 is then pressed against the metal sheet 11 in the center of a deep-drawing region 11*a* of the sheet metal 11 by the pressure $F_5$, and the counter plunger 7 is pressed against the sleeve 8 with the flange 7*a* by a pressure $F_7-F_5$. Initially, the counter pressure $F_7$ on the counter plunger 7 is larger than the pressure $F_5$ on the drawing plunger 5. In this way, a satisfactory electric pressure contact is established between a contact surface 5*a* at the end of the drawing plunger 5 and the metal sheet 11. However, cold-drawing of the metal sheet 11 into the drawing ring 2 at the deep-drawing region 11*a* is simultaneously avoided.

Figure 2:
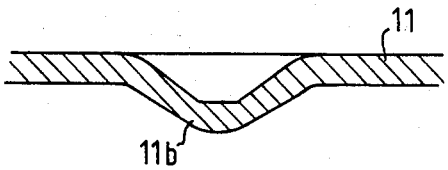
FIG. 2 is a fragmentary cross-sectional view of sheet metal deep-drawn according to the method of the invention.

The switch 10 is then closed for a short time and deep-drawing region 11*a* of the metal sheet 11 is heated by electric current which flows through the metal sheet 11 and is uniformly distributed between the contact surface 5*a* of the drawing plunger 5, the metal sheet 11 and the contact surface 2*a* of the drawing ring 2, and uniformly heats the contact surface 2*a*. After the switch 10 is opened, the counter pressure $F_7$ is reduced and/or the pressure $F_5$ is increased so that the metal sheet 11 is deep-drawn into the drawing ring 2 at the still hot deep-drawing region 11*a*. If required, this deep-drawing process can also be carried out with the switch 10 closed, i.e., during continuous heating of the deep-drawing region 11*a* of the metal sheet 11 through which electric current flows. Finally, a bump or projection 11*b* shown in FIG. 2 is produced at the deep-drawing region 11*a*.

Figure 3:
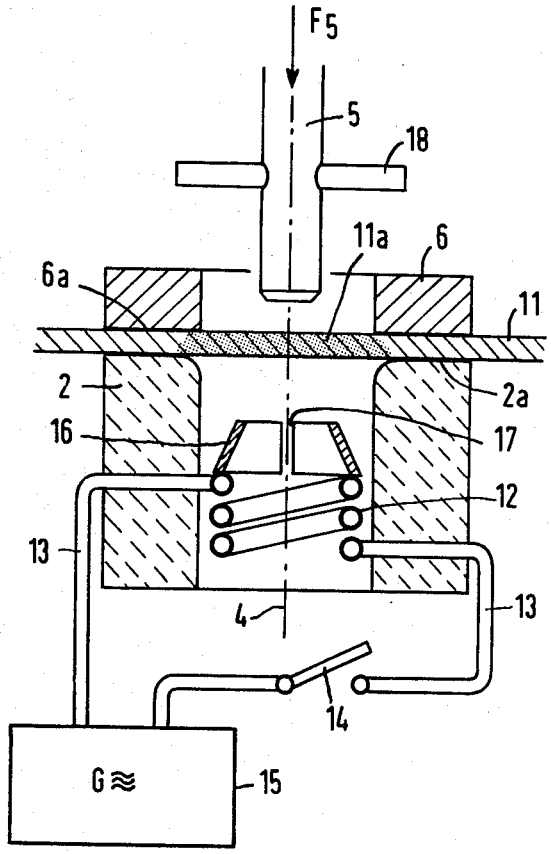
FIG. 3 is a fragmentary cross-sectional view of another apparatus for carrying out the method according to the invention.

In FIG. 3 parts which are similar to those in FIG. 1 are provided with the same reference symbols. Like FIG. 1, the FIG. 3 device has a drawing ring 2 with a vertical ring axis 4, but this drawing ring is formed of an electrically non-conducting material, such as ceramic. An annular pressure body 6 formed of ceramic material or of metal such as molybdenum, is provided coaxial to and opposite the drawing ring 2. The drawing ring 2 and the pressure body 6 have respective flat contact surfaces 2*a* and 6*a* on opposite ends thereof, between which a metal sheet 11 of a zirconium-tin alloy is disposed. An elongated cylindrical drawing plunger 5 formed of metal, such as steel, is associated with a non-illustrated pneumatic cylinder and is likewise guided in the drawing ring 2. The longitudinal axis of the drawing plunger 5 is coaxial with the drawing ring 2 and the annular pressure body 6, and the drawing plunger 5 is movably guideable through the annular pressure body 6 along the direction of the longitudinal axis thereof.

With respect to structure and operation, the apparatus according to FIG. 3 differs from the apparatus according to FIG. 1 in that an induction coil 12 is disposed in the drawing ring 2 and coaxial with the drawing ring 2. The induction coil 12 has a feed 13 which extends to the outside transversely through the drawing ring 2 and which is connected through a switch 14 to a high-frequency generator 15. A concentrator 16 shaped like a truncated cone is disposed at the end of the coil 12 facing the pressure body 6. The concentrator 16 may be formed of sheet metal such as copper, which is electrically conducting and is provided with a continuous separating slot 17 therein, extending in the axial direction. The drawing plunger 5 is provided with a transverse pin 18 which comes to a stop at the annular pressure body 6 when the sheet 11 is deep-drawn, and thus maintains a predetermined depth.

In the apparatus according to FIG. 3, the deep-drawing point or region 11*a* of the metal sheet 11 is heated after the brief closing of the switch 14 by means of a high-frequency electro-magnetic field which is generated by the induction coil 12 and covers the deep-drawing region 11*a* of the metal sheet 11.

After the switch 14 is opened, the drawing plunger 5 is moved by a force $F_5$ in the axial direction of the drawing ring 2, and forms a bump or projection without cracks in the metal sheet 11 at the deep-drawing region 11*a* corresponding to the bump 11*b* in FIG. 2.

In this manner it was possible to produce bumps 11*b* without cracks in a metal sheet of a zirconium-tin alloy which was 0.55 mm thick. The bumps were 1.6 mm deep with a base diameter of 5.5 mm. Such metal sheets provided with bumps 11*b* are used for manufacturing spacers in nuclear reactor fuel assemblies. The fuel rods in the assemblies filled with nuclear reactor fuel rest against the outside of these bumps.

Regarding the embodiment of FIG. 1, it is, of course, also possible to connect the current source 9 to the counter plunger 7 as well as or in addition to the drawing plunger 5 and to connect it to the pressure body 6 as well as or in addition to the drawing ring body 2.

The foregoing is a description corresponding in substance to German Application No. P 32 35 716.8, dated Sept. 27, 1982 and No. P 33 25 820.1, dated July 18, 1983, the international priority of which is being claimed for the instant application, and which are hereby made part of this application. Any material discrepancies between the foregoing specification and the aforementioned corresponding German applications are to be resolved in favor of the latter.

I claim:

1. Method for deep-drawing sheet metal in a drawing apparatus having a drawing ring body, a pressure body, a drawing plunger, and a counter plunger, which comprises pushing a metal sheet having a deep-drawing region against the drawing ring body with the pressure body surrounding the deep-drawing region, pushing the drawing plunger and the counter plunger along the longitudinal axes thereof against the deep-drawing region for clamping substantially the center of the deep-drawing region from opposite sides of the metal sheet, and heating the deep-drawing region with an electric current flowing between at least one of the plungers and at least one of the bodies as well as through the deep-drawing region for deep-drawing.

2. Apparatus for deep-drawing sheet metal, comprising a drawing ring body, a pressure body for pushing a metal sheet with a deep-drawing region against said drawing ring body with said pressure body surrounding the deep-drawing region, a drawing plunger guidable through said pressure body along the longitudinal axis thereof and insulated from said pressure body for clamping one side of the metal sheet substantially at the center of the deep-drawing region and for deforming the deep-drawing region, a counter plunger insulated from said drawing ring body, said counter plunger being guidable through said drawing ring body along the longitudinal axis thereof toward said drawing plunger for clamping a side of the metal sheet opposite the one side substantially at the center of the deep-drawing region, an insulating material sleeve electrically insulating said counter plunger from said pressure body, a first terminal connected to at least one of said plungers, a second terminal connected to at least one of said bodies, and an electric current source connected to said terminals for heating the deep-drawing region for deep-drawing.

* * * * *